US005771806A

United States Patent [19]

Imamaki

[11] Patent Number: 5,771,806

[45] Date of Patent: Jun. 30, 1998

[54] STAMP WITH RESILIENT FRAME

[75] Inventor: Teruo Imamaki, Kasugai, Japan

[73] Assignee: Brother Kogyo Kabushiki Kaisha, Nagoya, Japan

[21] Appl. No.: 747,386

[22] Filed: Nov. 12, 1996

[30] Foreign Application Priority Data

Nov. 20, 1995 [JP] Japan ..... 7-325112

[51] Int. Cl.[6] ..... B41K 1/42

[52] U.S. Cl. ..... 101/333; 101/368

[58] Field of Search ..... 101/333, 379, 101/368, 125

[56] References Cited

U.S. PATENT DOCUMENTS

| | | | |
|---|---|---|---|
| 2,966,116 | 12/1960 | Harris | 101/368 |
| 3,377,949 | 4/1968 | Prince | 101/379 |
| 3,886,863 | 6/1975 | Carabott et al. | 101/125 |
| 4,347,787 | 9/1982 | Takaka et al. | 101/313 |
| 4,441,422 | 4/1984 | Dreeben | 101/125 |
| 4,986,175 | 1/1991 | Boehringer et al. | 101/125 |
| 5,253,581 | 10/1993 | Miki et al. | 101/121 |
| 5,483,880 | 1/1996 | Seo et al. | 101/125 |
| 5,595,112 | 1/1997 | Seo | 101/33 |
| 5,601,644 | 2/1997 | Yasoshima | 101/333 |

FOREIGN PATENT DOCUMENTS

| | | |
|---|---|---|
| 0 553 999 A1 | 4/1993 | European Pat. Off. . |
| 62-156982 | 7/1987 | Japan . |

*Primary Examiner*—Edgar S. Burr
*Assistant Examiner*—Anthony H. Nguyen
*Attorney, Agent, or Firm*—Oliff & Berridge, PLC

[57] ABSTRACT

A stamp has a stencil paper at a central portion of which a stamp pattern is formed including an ink permeable portion and an ink impermeable portion. A frame member holds an outer peripheral portion of the stencil paper, and an ink impregnated body is arranged with the frame member in contact with the central portion of the perforated stencil paper. The frame member and ink impregnated body are secured to a supporting member. A groove is formed in the supporting member between the frame member and the ink impregnated body. The stamp assembly is capable of stamping with no leakage of ink outside the device and with no peeling off of the stencil paper.

15 Claims, 2 Drawing Sheets

STAMP WITH RESILIENT FRAME

BACKGROUND OF THE INVENTION

1. Field of the Invention

The present invention relates to a stamp that transfers a pattern corresponding to a stamp pattern on recording paper. Transfer of the pattern occurs by press-contacting ink impregnated in an ink impregnated body onto the recording paper via a stamp surface member having the stamp pattern. The stamp surface member comprises an ink permeable portion and an ink impermeable portion.

2. Description of the Related Art

Conventionally, a stamp is known that has an ink impregnable body impregnated with ink and a perforated stencil in which is formed a stamp pattern comprising a permeable portion, which permits ink to permeate, and an impermeable portion, which does not permit ink to permeate. According to such a stamp, the stamping is conducted by transferring ink from the ink impregnated body onto recording paper via the perforated stencil.

FIG. 4 illustrates an example of the conventional stamp. A perforated stencil 3 is formed by a porous supporter layer and thermal sensitive resin layer in which an ink permeable portion corresponding to a stamp pattern is formed by perforating the thermal sensitive resin layer by using a thermal head based on stamp pattern information. In the conventional case, the perforated stencil 3 is used in a state where it is fixed onto an ink impregnated body 2 impregnated with ink by the adhesive force of ink.

In FIG. 4, the ink impregnated body 2 is supported by a supporting member 8, which is provided with a handle 9. When the stamp is pressed onto recording paper by being held by the handle 9, the ink impregnated body 2 is compressed. This causes the ink to ooze out of the ink impregnated body 2 from the perforated portions of the perforated stencil 3. The ink then transfers onto the recording paper.

However, according to such a stamp, ink also oozes out from side faces 22 of the ink impregnated body 2 at the time of stamping. Further, the perforated stencil 3 is brought in close contact with the ink impregnated body 2 by the adhering force of ink. Therefore, when the adhering force of ink is lowered by high temperatures or other environmental influences, the perforated stencil 3 may peel off from the ink impregnated body 2 at the time of stamping.

SUMMARY OF THE INVENTION

An object of the invention is to provide a stamp that avoids leakage of ink from side faces of an ink impregnated body.

Another object of the invention is to provide a stamp that is capable of preventing a stamp surface member from peeling off from the ink impregnated body during stamping.

In order to achieve at least the above-mentioned objects, a stamp in accordance with the invention is provided with a stamp surface member having a central portion with a stamp pattern comprising a portion permitting ink to permeate therethrough and a portion prohibiting ink from permeating therethrough. A frame member holds an outer peripheral portion of the stamp surface member. An ink impregnated body arranged at an inner portion of the frame body contacts the central portion of the stamp surface member.

Further, it is possible to provide a groove between the frame member and the ink impregnated body. Both the frame member and the ink impregnated member are fixed to a base member, and the groove may be formed on a face of the base member.

Further, according to the stamp of the invention, since the groove is formed between the frame member and the ink impregnated body, the ink on the side of the ink impregnated body is prevented from moving to the side of the frame member, even if stamping is repeated.

Additionally, according to the stamp of the invention, due to the formation of the groove, even if the ink impregnated body is compressed to the extent that the stamp surface member is brought into contact with the face of the securing member, the contact state does not take place at the groove. Therefore, ink is prevented from being led from the stamp surface member to the securing member past the groove to the exterior side.

As explained above, according to the stamp of the invention, the stamp surface member is held by the frame member that is formed at the outer side of the ink impregnated body. Therefore, the stamp surface member does not peel off even if the adhering force between the stamp surface member and the ink impregnated body becomes weak.

Furthermore, an adhesive layer for adhering to the stamp surface member may be formed on the surface of the frame body. In this case, the adhesive layer for adhering the stamp surface member is formed on the surface of the frame member. Therefore, mounting of the stamp surface member is simplified, and the stamp surface member is difficult to peel off.

According to the stamp of the present invention, the frame member is formed by an elastic body. Therefore, the frame member is deformed in accordance with the surface that is being stamped. So, the surface of the stamp surface member and the stamped surface are brought into full contact with each other. Also, due to the formation of the groove and since the stamp surface member is securely fixed onto the frame member by the adhesive layer, the stamp surface member does not peel off even if the adherence between the stamp surface member and the ink impregnated body becomes weak. Furthermore, the ink impregnated body is pushed uniformly onto the surface since the frame member, having a larger elastic force than that of the ink impregnated body, surrounds the ink impregnated body.

BRIEF DESCRIPTION OF THE DRAWINGS

Preferred embodiments of the invention will be described in detail with reference to the following figures wherein.

DETAILED DESCRIPTION OF PREFERRED EMBODIMENTS

An explanation will be given of a stamp in accordance with the present invention based on a preferred embodiment of the present invention.

Figure 1:
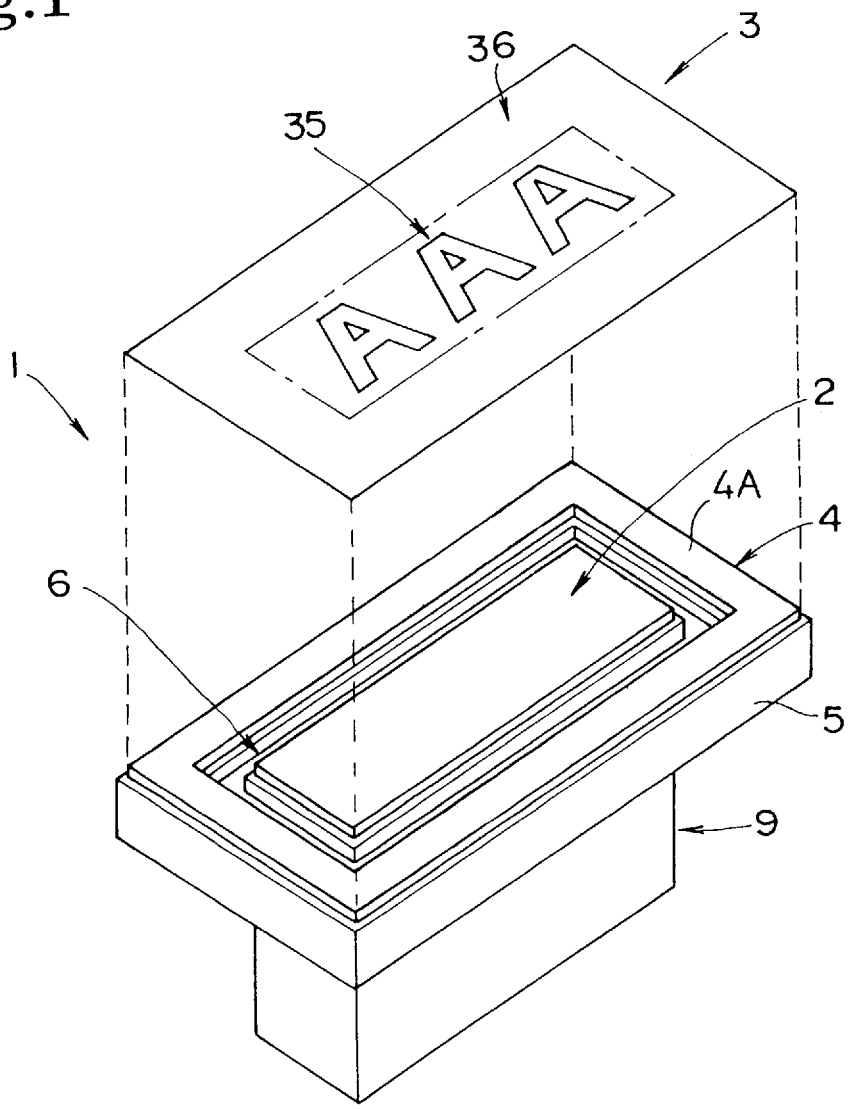
FIG. 1 is an exploded perspective view showing a stamp of an embodiment of the present invention.

FIG. 1 shows a stamp of an embodiment according to the present invention. As illustrated in FIG. 1, a frame member 4 formed by an elastic, resilient body is fixed at an outer edge portion of the outer supporting surface of a supporting member 5. The frame member 4 is provided with an adhesive layer formed by an adhesive agent for securing a stamp surface member, preferably stencil paper, 3, described below, on an outer surface as seen in FIG. 1.

An ink impregnated body 2, adapted to be impregnated with ink before use, is fixed within the frame member 4 and on the surface of the supporting member 5 by an adhesive agent. The ink impregnated body 2 is formed of preferably an elastic foamed body or unwoven cloth made of a synthetic resin material, including but not limited to, for example, polyethylene, polypropylene, polyethylene terephthalate, polyurethane. The ink impregnated body 2 is impregnated with an ink, such as an oil based ink, to the extent of a substantially saturated state. When pressure is applied to the ink impregnated body 2, the ink oozes out. The frame member 4 is formed by an elastic, resilient body having a larger elastic force than the ink impregnated body 2, for example, acrylonitrile-butadiene rubber.

The frame member 4 is provided with an adhesive layer 4A the surface of which is formed by an adhesive agent. One side of a stencil paper 3, which is the stamp surface member in this embodiment, is secured to the adhesive layer 4A on the frame member 4. The stencil paper 3 has a stamp pattern formed by an ink permeable portion and an ink impermeable portion.

Figure 2:
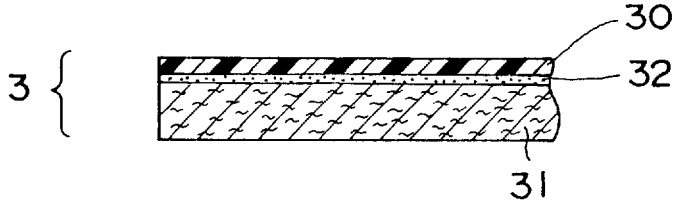
FIG. 2 is a partial side view in section showing a perforated stencil of FIG. 1.

FIG. 2 shows the constitution of the perforated stencil 3. As shown in FIG. 2, the stencil paper 3 includes thermoplastic film 30 and a porous supporter 31 adhered by an adhesive agent layer 32.

The thermoplastic film 30 is preferably a film made of a thermoplastic resin material (for example, polyethylene terephthalate, polypropylene, and vinylidene chloride-vinyl chloride copolymer) having a thickness of about 1 through 4 micrometers, preferably about 2 micrometers.

The porous supporter 31 is preferably a porous thin leaf paper having a major raw material of natural fiber (for example, Manila hemp, kozo fiber, and mitsumata fiber), synthetic fiber (for example, polyethylene terephthalate, polyvinyl alcohol, and polyacrylonitrile) or semi-synthetic fiber of rayon, for example.

The stencil paper 3 is perforated into a desired pattern by irradiation of an infrared ray or by a thermal head. As shown in FIG. 1, the perforated portions of the stencil paper 3 include ink permeable portions 35, which permit ink to permeate through and the remaining ink impermeable portions 36, which do not permit ink to permeate through.

Further, the stencil paper 3 is of a size substantially the same as a rectangle prescribed by the outer four sides of the frame member 4 or corresponds to whatever shape the frame is formed as. At a central predetermined portion of the stencil paper, which is the portion in contact with the ink impregnated body 2, the stamp pattern is formed.

Figure 3:
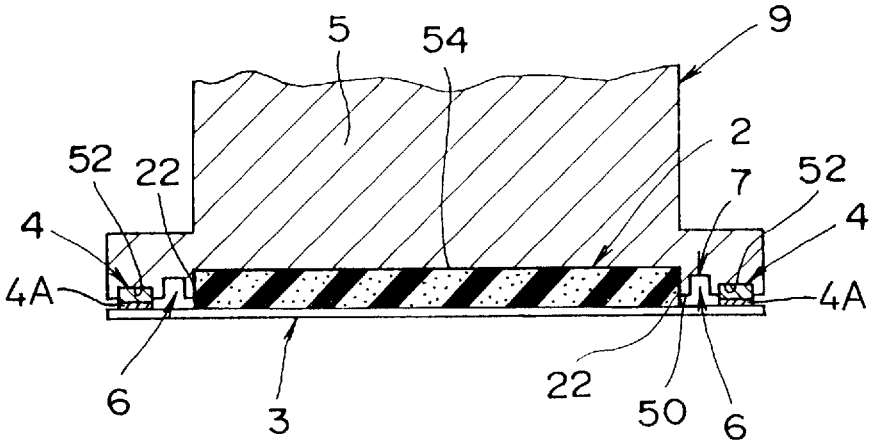
FIG. 3 is a partial side sectional view showing the stamp of FIG. 1.
Figure 4:
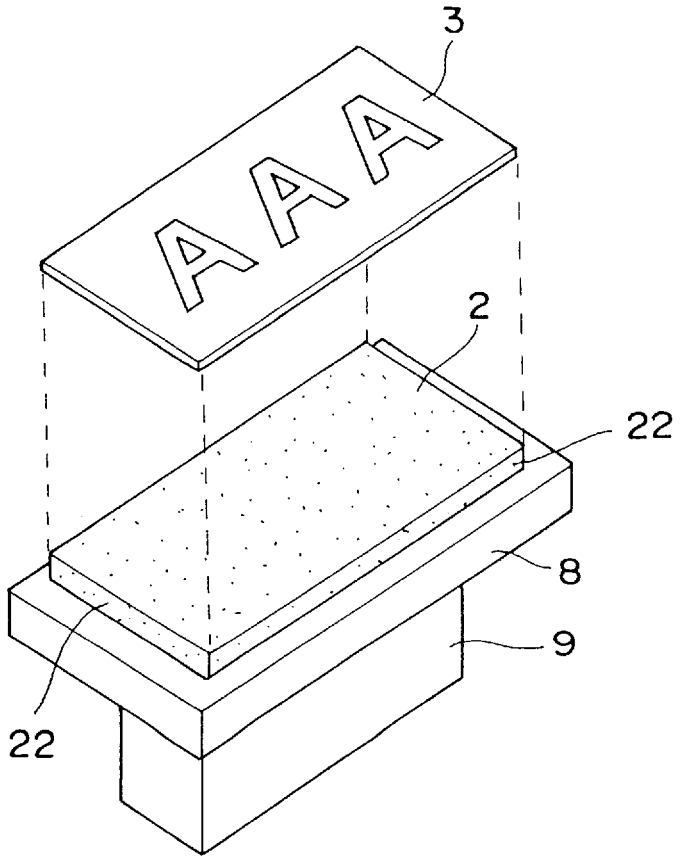
Fig.4 PRIOR ART
FIG. 4 is an exploded perspective view showing a conventional stamp.

FIG. 3 is a sectional view of the stamp 1. As illustrated in FIG. 3, a supporting face 50 for fixedly attaching the ink impregnated body 2 and the frame member 4 thereon is formed on the supporting member 5. A groove 52 for receiving the frame member 4 is formed at the outer edge portion of the securing face 50 and a recessed portion 54 for receiving the ink impregnated body 2 is formed at the central portion thereof.

The frame member 4 and the ink impregnated body 2 are respectively secured to the groove 52 and the recessed portion 54 by an adhesive agent. A predetermined amount of volume of the ink impregnated body 2 is embedded in the recessed portion 54 of the securing face 50. Therefore, the side faces of the ink impregnated body 2 are secured such that only portions thereof are exposed from the recessed portion 54. Thus, the amount of ink oozing out from the side faces during stamping can be reduced based on the size of the ink impregnated body 2.

The frame member 4 and the ink impregnated body 2 are spaced at an interval to form a gap 6 having a predetermined width and an overflow groove 7 having a predetermined width in the securing face 50.

When stamping is conducted on recording paper by the stamp 1 designed as described above, ink impregnated in the ink impregnated body 2 is transferred on the recording paper via the perforated stencil 3. The ink impregnated body 2 is compressed during stamping. Therefore, ink oozes out from the side faces 22 of the ink impregnated body 2. Although in this case the oozed ink is stored at the gap 6, it cannot leak outside the stamp device since it is stopped by the portion where the frame member 4 and the stencil paper 3 adhere to each other. When the stamping is finished and the compression of the ink impregnated body 2 is released, the ink stored in the gap 6 is absorbed into the ink impregnated body 2.

Also, when the ink impregnated body 2 and the frame member 4 are significantly compressed by being applied with a strong pressing force, the stencil paper 3 may be brought into contact with the securing face 50. When the stencil paper 3 and the securing face 50 are brought into contact with each other, ink oozed out from the side faces of the ink impregnated body 2 is led to the outer side along the area where the stencil paper 3 and the securing face 50 are brought into contact with each other. However, the stencil paper 3 and the securing face 50 do not contact at the overflow groove 7. Therefore, the ink does not leak past the overflow groove 7. When the stamping is finished and the compression of the ink impregnated body 2 is released, the ink stored in the overflow groove 7 is re-absorbed into the ink impregnated body 2 by flowing across the gap 6.

Also, since the stencil paper 3 is fixed to the frame member 4 securely by the adhesive agent (adhesive layer 4A), the stencil paper 3 is not peeled off, even if the viscosity of ink is lowered and the adhering force between the stencil paper 3 and the ink impregnated body 2 becomes weak.

Additionally, in pressing the stamp 1 on the recording paper, the ink impregnated body 2 is uniformly pushed with no deviation in the surface since the surrounding frame member 4 has a larger elastic force than that of the ink impregnated body 2.

While preferred embodiments of the invention have been described using specific terms, such description is for illustrative purposes only. It is to be understood that changes and variations may be made without departing from the spirit or scope of the appended claims.

What is claimed is:

1. A stamp for forming an image on a recording medium comprising:

a supporting member having a supporting surface with a peripheral edge;

an ink impregnable member disposed on the supporting surface of the supporting member;

an elastic frame disposed on the peripheral edge of the supporting surface of the supporting member surrounding the ink impregnable member, the supporting member having a groove formed in the surface thereof at the peripheral edge in which the frame is received; and a stamp surface member having an ink permeable portion and an ink impermeable portion forming an image pattern therein, the stamp surface member being secured to the elastic frame over the ink impregnable member.

2. The stamp of claim 1 wherein the frame has a first side adhered to the supporting surface of the supporting member and a second opposite side adhered to the stamp surface member, the stamp surface member being sealingly engaged to the supporting member.

3. The stamp of claim 1 wherein the supporting member includes a handle.

4. The stamp of claim 1 wherein the supporting member has a recessed portion in which the ink impregnable member is received, the recessed portion being formed in a portion of the surface inwardly spaced from the groove, thereby forming a gap between the frame and the ink impregnable member.

5. The stamp of claim 4 wherein the supporting member has an overflow groove formed in the surface thereof located in the gap between the frame and the ink impregnable member.

6. The stamp of claim 1 wherein the supporting member has an overflow groove formed in the surface thereof located adjacent to and inwardly spaced from the groove in which the frame is received.

7. The stamp of claim 1 wherein the supporting member has an overflow groove formed in the surface thereof surrounding the ink impregnable member and inwardly spaced from the peripheral edge.

8. The stamp of claim 1 further comprising an adhesive layer disposed between the frame and the stamp surface member.

9. The stamp according to claim 1 wherein the stamp surface member is stencil paper.

10. The stamp of claim 1 wherein the frame has a first elastic force and the ink impregnable member has a second elastic force, wherein the first elastic force is larger than the second elastic force.

11. A stamp assembly comprising:

a base member having a surface with a peripheral edge and a groove formed therein spaced inwardly from the peripheral edge;

a frame member provided on the base member and positioned at the peripheral edge outwardly of the groove formed in the surface of the base member, the frame member being an elastic body;

an ink impregnated body provided on the base member and positioned inwardly of the groove formed in the surface of the base member and spaced from the frame member by the groove, the ink impregnated body being an elastic body having a smaller elastic force than the frame member; and a stencil member, having a pattern formed by an ink permeable portion and an ink impermeable portion, the stencil member secured over the frame member and in contact with the ink impregnated body.

12. The stamp assembly of claim 11 wherein the ink impregnated body has a contact surface in a plane elevated from the surface of the base member and the frame has a contact surface in the same plane as the ink impregnated body.

13. The stamp assembly of claim 12 further comprising an adhesive layer formed on the contact surface of the frame member for adhering to the stencil member.

14. The stamp assembly of claim 11 wherein the base member has a second groove formed in the surface thereof at the peripheral edge that receives the frame member therein.

15. The stamp assembly of claim 11 wherein the base member has a recessed portion formed in the surface thereof that receives the ink impregnated body therein.

* * * * *